US008957774B2

(12) United States Patent
Goldblatt

(10) Patent No.: US 8,957,774 B2
(45) Date of Patent: Feb. 17, 2015

(54) CONCEALED PERSONAL ALARM AND METHOD

(76) Inventor: Vivian B. Goldblatt, Paramus, NJ (US)

( * ) Notice: Subject to any disclaimer, the term of this patent is extended or adjusted under 35 U.S.C. 154(b) by 476 days.

(21) Appl. No.: 12/932,294

(22) Filed: Feb. 22, 2011

(65) Prior Publication Data

US 2012/0212339 A1 Aug. 23, 2012

(51) Int. Cl.

| | |
|---|---|
| ***G08B 1/08*** | (2006.01) |
| ***G08B 13/08*** | (2006.01) |
| ***G08B 13/14*** | (2006.01) |
| ***G08B 25/01*** | (2006.01) |

(52) U.S. Cl.

CPC ..... *G08B 25/016* (2013.01)
USPC ..... 340/539.11; 340/568.1; 340/568.8; 340/539.15; 340/546; 340/572.8

(58) Field of Classification Search

CPC ..... G08B 25/10; G08B 25/016; G08B 13/00; G08B 21/0446; G08B 21/088
USPC ..... 340/568.1–568.8, 539.11–539.15, 546, 340/572.8

See application file for complete search history.

(56) References Cited

U.S. PATENT DOCUMENTS

| | | | | |
|---|---|---|---|---|
| 4,812,068 | A * | 3/1989 | Seong | 401/195 |
| 5,025,247 | A * | 6/1991 | Banks | 340/574 |
| 5,652,570 | A * | 7/1997 | Lepkofker | 340/573.4 |
| 6,362,778 | B2 * | 3/2002 | Neher | 342/357.75 |
| 6,744,463 | B2 | 6/2004 | Rye et al. | |
| 7,280,810 | B2 | 10/2007 | Feher | |
| 7,612,678 | B1 | 11/2009 | Potter et al. | |
| 7,720,572 | B2 | 5/2010 | Ziegler | |
| 7,724,133 | B2 | 5/2010 | Laitta et al. | |
| 7,729,532 | B2 | 6/2010 | Tedesco | |
| 7,743,025 | B2 | 6/2010 | Fernandez | |
| 7,751,534 | B2 | 7/2010 | Sun | |
| 7,928,846 | B2 * | 4/2011 | Greenlee et al. | 340/572.3 |
| 2005/0248453 | A1 * | 11/2005 | Fechter | 340/539.15 |
| 2009/0212920 | A1 * | 8/2009 | Yang | 340/10.3 |
| 2009/0212939 | A1 * | 8/2009 | Richmond | 340/539.11 |

OTHER PUBLICATIONS

Alert One—Personal Alert Button for Home Medical Alert System http://www.alert-1.com/Products-Personal-Alert-Button.aspx.
LoJack Security Systems http://www.lojack.com/.
Kaishot http://www.kai-shot.com/.

* cited by examiner

*Primary Examiner* — George Bugg
*Assistant Examiner* — Munear Akki
(74) *Attorney, Agent, or Firm* — Gregor N. Neff

(57) ABSTRACT

A transmitter, GPS, clock and, optionally, a microphone, video camera and identification signal means, and health monitoring sensors are housed in personal articles such as a pendant, a watch, a ring, mobile telephone, or other personal article. The article is disguised to look like it does not have all or some of said features, and is provided with a switching device, preferably operable with one hand, to turn the transmitter on. Preferably, the switching device has two switching elements which require simultaneous operation to energize the transmitter, so as to minimize false alarms. The method of use includes selecting the best-suited type of transmitter, causing emergency personnel to be prepared to act when receiving transmission from the alarm device, and advising users on carrying the modified personal article when protection is desired.

18 Claims, 3 Drawing Sheets

FIG. 5
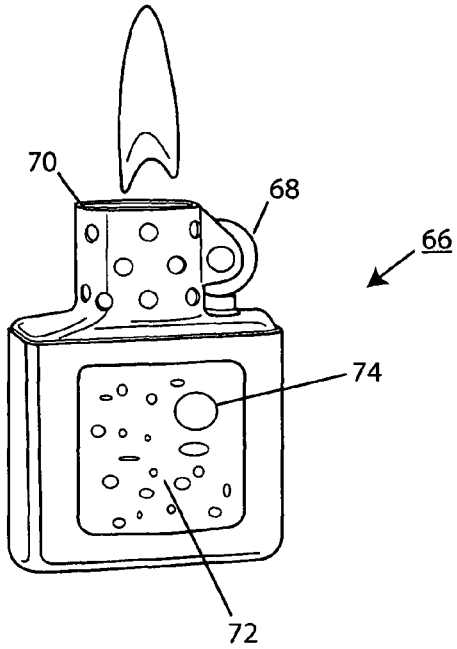
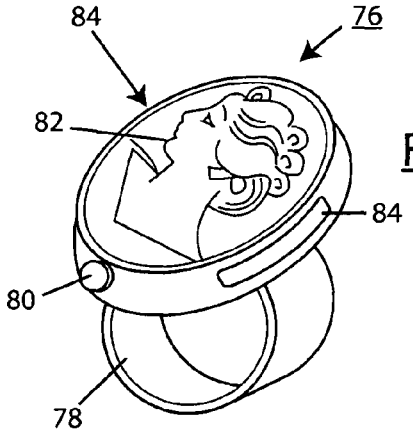
FIG. 6
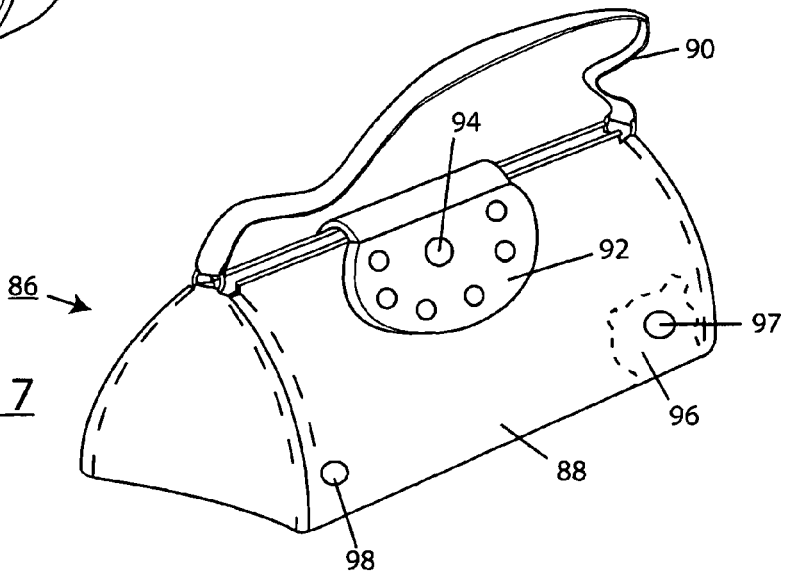
FIG. 7

FIG. 8
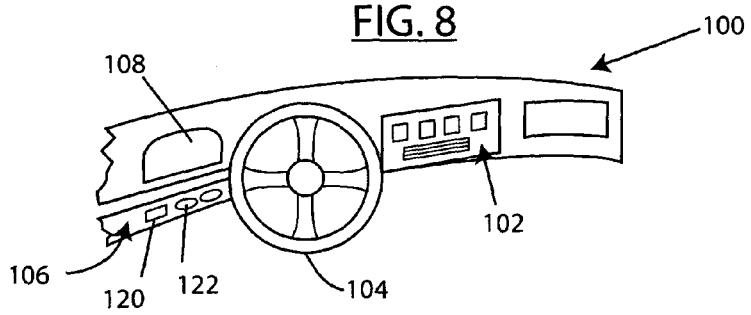
FIG. 9
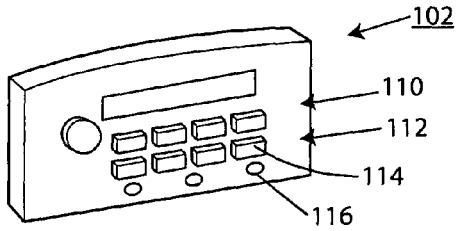
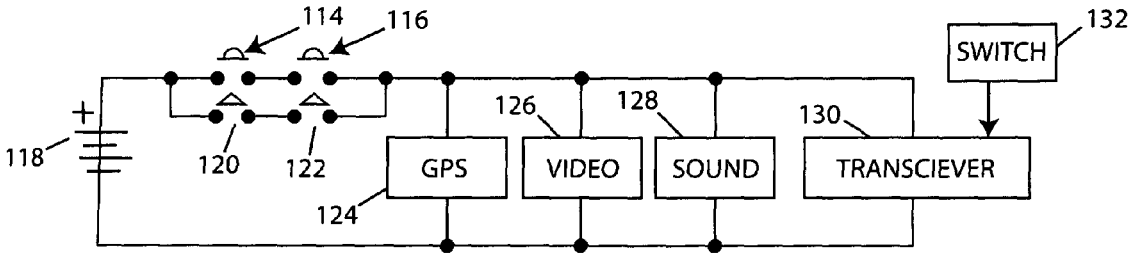
FIG. 10
FIG. 11
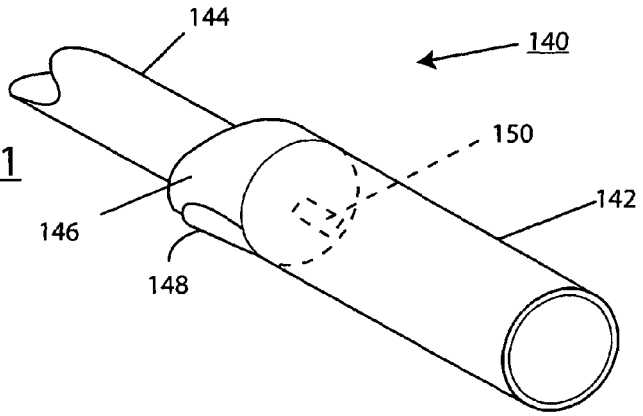

CONCEALED PERSONAL ALARM AND METHOD

CROSS-REFERENCE TO RELATED APPLICATION

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION (1) Field of Invention

This invention relates to emergency alarm devices and methods and particularly to concealed personal emergency alarm devices and methods.

(2) Description of Related Art Including Information Disclosed Under 37 CFR 1.97 and 1.98

A very serious and agonizing problem is caused by kidnappings, abductions, and other emergencies such as health emergencies which occur when the individual involved is away from other people, or in environs where no one is nearby to help.

Many devices and methods have been proposed in the past to enable people in such predicaments to signal emergency personnel to give aid. However, such prior devices have many shortcomings. It is an object of the invention to provide an emergency alarm device and method which overcome many of the shortcomings of prior proposals.

In particular, it is an object of the invention to provide a personal emergency alarm which can be carried by a person and can be concealed and disguised readily to prevent perpetrators from disabling the device before a message can be sent for help.

It also is an object of the invention to gather, store and send as much information as is possible about the victim(s), injured party (or parties), and/or perpetrator(s) to both provide assistance to the victim(s) and/or injured party (or parties) and apprehension of the perpetrator(s).

BRIEF SUMMARY OF THE INVENTION

In accordance with the present invention, the foregoing objectives are met by the provision of a signal transmitter, a power supply, a GPS device, and a switching device in a compact housing which is disguised as a personal article worn or carried by the person to be protected. The switching device allows the wearer to activate the emergence alarm without alerting a nearby perpetrator and without any substantial chance of sending false alarms.

Optionally, sound detectors, video cameras, sound/video storage, and health monitors can be included to give more information to emergency personnel and for identifying victims, injured parties and perpetrators. Optionally, a transceiver is selected to both transmit and receive when there is no danger in receiving wireless communications, i.e., when no perpetrator is present.

In accordance with the present invention, the miniature components of the device are contained in a housing disguised as another object often worn or kept in the possession of people, such as pendants, wristwatch, handbag, back pack, cigarette lighter, ring, and many other such personal articles. In another embodiment, the components are hidden in or on a vehicle such as a truck, motorcycle, bicycle or automobile, and the operating controls are disguised.

Preferably, when activated, the alarm device automatically transmits signals wirelessly to a location where emergency personnel will be alerted by the signals, such as a police station, fire station, hospital, family members/guardians, etc. The signals can be transmitted wirelessly by use of cell phone communications, RF transmission, satellite communication, or other wireless communication suited to the environment in which the device is to be used.

Optionally, sound and/or video transmitted from the location of the incident can be recorded in the alarm device, and/or at the emergency personnel location. Video images can be compressed and stored as well. The audio signals preferably are compressed to facilitate storage in the somewhat limited memory available in the device.

In addition to hand-operated switching devices to turn the alarm device on, the device can be turned on by biometric sensors detecting the fingerprint, sound, or facial and eye and skin features, or other feature of the person using the device, so as to give the user a chance to actuate the alerting device under different circumstances of his or her disability, preference or ability.

Preferably, a service organization is provided to distribute the remote alerting devices, secure the necessary emergency response services, and gather data to help protect against compromise or the unwanted discovery of the devices by others.

The above and other objects and advantages of the invention will be described in and/or apparent from the following descriptions and drawings.

BRIEF DESCRIPTION OF THE SEVERAL VIEWS OF THE DRAWING(S)

FIG. 5 is a perspective view of a cigarette lighter incorporating the present invention, FIG. 6 is a perspective view of a cameo ring incorporating the alarm device of the present invention;

FIG. 7 is a perspective view of a purse, briefcase or shoulder bag incorporating the invention;

FIG. 8 is a perspective schematic view of a vehicle dashboard in which the invention is used;

FIG. 9 is an enlarged, schematic perspective view of a component of the dashboard of FIG. 8;

FIG. 10 is an electrical circuit diagram of the alerting device used in the vehicle of FIGS. 8 and 9, and an optional variant of the circuit diagram of FIG. 3; and FIG. 11 is a schematic diagram representative of a part of a motorcycle, motor scooter, bicycle, ATV, snowmobile, or other two- or three-wheeled motor-powered or manually-powered vehicle using the invention.

DETAILED DESCRIPTION OF THE INVENTION

Pendant

Figure 1:
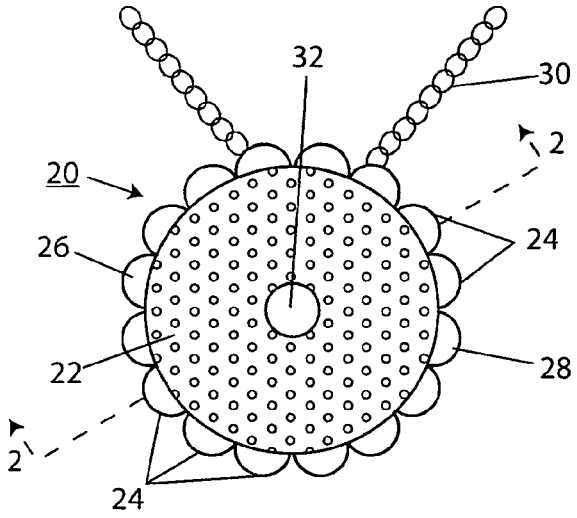
FIG. 1 is a front elevation view of a pendant that houses an embodiment of the alarm device of the present invention.

FIG. 1 of the drawings shows one embodiment of the invention in which the alarm device is made part of a pendant 20 which has the appearance of an ordinary article of jewelry worn by a person, normally a woman, on a chain 30, around her neck.

Figure 2:
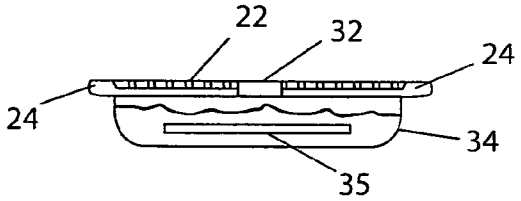
FIG. 2 is a bottom plan view, partially in cross-section, taken along line 2-2 of FIG. 1.

The pendant 20 has a broad circular surface 22 which has fine openings to serve as a grille for a microphone mounted in a housing 34 (FIG. 2) attached to the rear surface of the pendant. The pendant also has protruding decorative lobes 24 around its periphery.

Two of the lobes 26 and 28 are inwardly moveable and spring-loaded. They are toggle switches used to energize the alarm device, as it will be described below.

In the center of the pendant is an opening 32 for an optional video camera lens. The opening 32 is disguised to look like a part of the decoration of the pendant. A slot 35 in the housing (FIG. 2) provides for entry and withdrawal of a memory card for storing sound and video.

Figure 3:
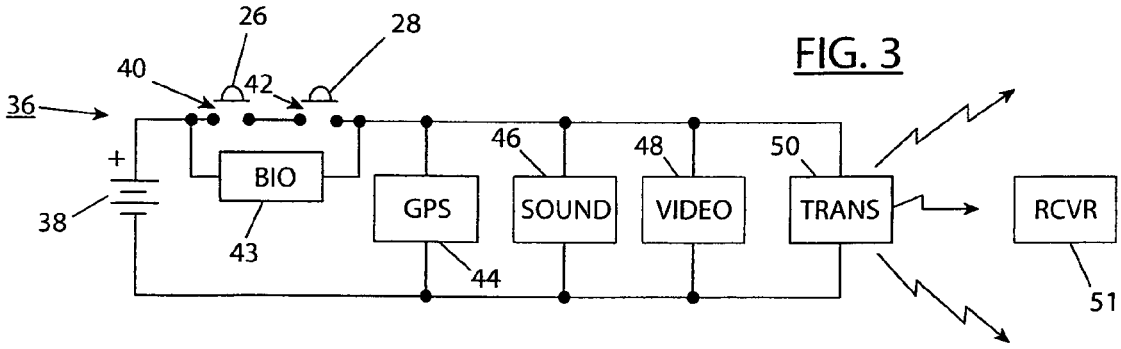
FIG. 3 is a schematic circuit diagram of an electrical circuit of the alarm device of the present invention.

FIG. 3 is an electrical circuit diagram illustrating the electrical connections of the components of the alarm device mounted in the pendant 20. The electrical components include a battery 38 as an electrical power supply. This battery can be a battery such as a non-rechargeable lithium battery used in wristwatches. Alternatively, the battery can be rechargeable. The switches 26 and 28 are shown in position to form a circuit between contacts 40 and 42. The contacts are connected in series with one another so that both switches 26 and 28 must be actuated simultaneously in order to activate the device in order to minimize false alarms.

Preferably, the switches 26 and 28 are conventional "toggle" switches, each of which can be pressed once to close it, and a second time to open it to disable the alarm device. It is advantageous to build in a time-delay function so that one must hold the switch closed for, say, one to a few seconds to disable the alarm device.

If desired, a separate hidden normally-closed switch can be provided to disable the device unbeknownst to a nearby person.

Several of the devices which can be used in the alarm unit include a GPS unit 44, a sound receiving and storing unit 46 which includes a microphone underneath the grille 22 for sound pick-up. If video unit 48 also is provided, the unit 48 includes a video camera with a lens aligned with the hole 32 in the pendant, as well as storage for the video recorded by the camera.

Time signals also are supplied to a wireless transmitter 50 from the GPS device 44.

The wireless transmitter, preferably a miniature transceiver, receives GPS, time, sound and video signals and transmits them to a remote station 51 where emergency personnel are present of can be summoned.

As an alternative or additional element of the switching device, a biometric recognition device 43 is provided. The biometric device is one of a known type which recognizes the face, eyes, skin texture, fingerprints, voice or other sound, of the person carrying the alerting device. The manual switches and the biometric switches can be used in parallel, if preferred, so that the user can actuate the alerting device by any one of the various means available, depending on what is possible under the circumstances of the emergency in progress.

The device views facial features through the opening 32 by means of the video camera, or through a different opening (not shown) if the video camera cannot be used. The microphone under the grille can be used for sound detection.

At the remote station, which can be located wherever emergency personnel are located or quickly available, such as a police station, a fire station, a hospital, ambulance station, private security organization or other emergency personnel location, is located a receiver 51, which is to receive the transmission from the transmitter 50, and from other alerting devices in use in the area. Preferably, the receiver system is adapted to light an indicator lamp or otherwise alert the personnel whenever a signal is received from one of the alerting devices of the invention.

The wireless transmission system can use any of a number of well-known wireless transmission methods, depending upon the terrain and environs of the area in which the alarm device is to be used.

One method is to use a cell phone transmitter or transceiver, which can be used in a wide area, including cities with tall buildings. Alternatively, shorter range communication systems, such as blue tooth, etc. can be used in the right circumstances. Ordinary radio transmission can be used to supplement or substitute for one of the other kinds of transmissions, if circumstances warrant the use.

It should be apparent that in order for the components shown in FIG. 3, or some of them to fit into a pendant or other personal article of reasonable size, the components should be compact. Miniature GPS devices, microphones, video cameras, and transmitters all are available for use in the sizes required.

If size and/or cost are constraints necessary to the commercialization of the product, a certain minimum number of components may be adequate under many circumstances. It is believed that the basic need is for a location device, a time indicator, a transmitter, and a switching device. The GPS device provides both the location and the time information.

In the smallest personal articles, it may be possible to use only the basic components. In larger articles, it may be possible to include sound pick-up, video camera, and storage facilities for their images and voice signals. As technology advances, these components can be expected to decrease in size, and increase in power, lifespan, durability, and distance of transmission, as done in prior years and continue to do so currently. As this happens, more features can be added to a device of a given size.

It is preferred that the transmitter of each alerting device is programmed to transmit a unique serial number whenever it operates. By this means, the owner can be identified Advantageously, the device shown in FIG. 1, or any of the other personal articles described herein, are sufficiently unobtrusive to prevent or deter a kidnapper or other perpetrator from detecting that it is an alarm device. Therefore, the perpetrator will be less inclined to deprive the victim of the device and prevent its use. This is in contrast with a device such as a cell phone, or other communications device, which a perpetrator might confiscate to prevent its use.

The provision of toggle switches which must be operated simultaneously in order to energize the device is advantageous in that it hinders false alarms from being transmitted by the device. It takes a deliberate, determined motion to simultaneously press both of the switches 26 and 28. Preferably, the switches are spaced apart and opposed so that they can be operated simply.

The toggle switches include latching circuits to keep them closed until they are pressed a second time, when they are opened to turn off the device. Thus, it takes a deliberate, knowledgeable action to turn the device on and off.

Furthermore, as noted above, the switches 26 and 28 are located opposite one another on opposite sides of the pendant 20 so that they can both be grasped by the fingers of one hand to close them. This enhances the unobtrusiveness of the motion needed to turn the device on.

Preferably, the casing 34 and other components of the alerting device are made reasonably shock-resistant, durable and waterproof, by known techniques.

Wristwatch

Figure 4:
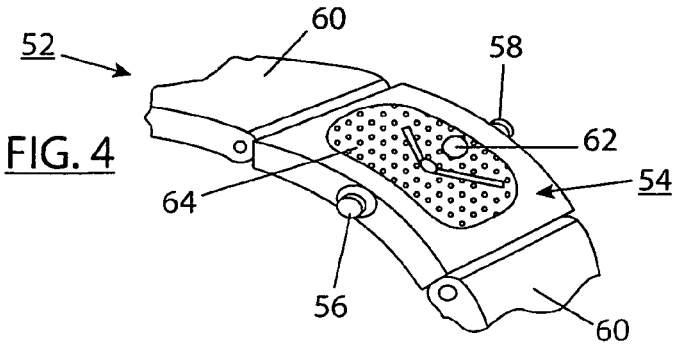
FIG. 4 is a perspective, partially broken-away view of a wristwatch incorporating the present invention.

FIG. 4 shows a wristwatch 52 which preferably is made large enough to contain the same components as described above for the pendant 20. The watch 52 has two toggle switches, 56 and 58, on opposite sides of the watch body 54. The wristwatch strap is shown on 60. An opening 62 for a tiny video camera and/or biometric identification means also is provided, and the watch face 64 is perforated to allow sound to enter into a microphone positioned below the watch face. In other respects, the operation of the device shown in FIG. 4 is the same shown in the device shown in FIGS. 1 through 3.

Cigarette Lighter

FIG. 5 shows a cigarette lighter 66 which also houses a mechanism such as that used in devices of FIGS. 1 through 4, as described above.

As an alternative to opposed toggle switches, a fingerprint-actuated switch 72 is shown. An opening 74 for the video camera and/or biometric detection also is shown. The flint 68 and the flame containing area 70 of the lighter also are shown.

As noted above, on opposite sides of the lighter, manually-operable toggle switches (not shown) can be located to operate the alarm device.

Finger Ring

FIG. 6 shows a cameo finger ring which has at least the basic operative components such as those shown in FIGS. 1 through 5 and described above, with two spring panels 84 on opposite sides of the face 80 of the ring, bearing a cameo 82 design. The band of the ring is shown at 78.

Purse/Attache/Shoulder Bag/Book Bag

FIG. 7 shows a carrying bag 86 such as a purse, attaché case, shoulder bag, or other such personal article.

The bag 86 includes a body 88, a carrying strap 90 and a relatively large closure clasp 92. The operative components of the alerting device are housed in the clasp 92. A viewing hole 94 is provided for video/biometric use, and the clasp area is perforated to allow sound entry to a microphone.

An alternative covert location for the alerting device is indicated at 96. The device is inside the bag in one corner. A view hole 97 is provided. Perforations are provided for the microphone. A decoration 98 is provided to give the hole 97 a decorative appearance.

Opposed switch contacts are provided in each location so the victim can either press the sides of the clasp 92 or reach into the corner of the bag and switch the device on, as indicated in the drawing.

Enclosed Motor Vehicles

FIGS. 8-10 show the use of the invention concealed in an enclosed motor vehicle. The components of the alerting device can be hidden in a variety of different locations in the vehicle. The vehicle can be any enclosed vehicle, such as an automobile, truck, train, bus, covered boat, airplane, etc.

FIG. 8 schematically shows an automobile or truck dashboard 100, with a steering wheel 104 and steering column 106, a radio/tape/CD or DVD player console 102, and a speedometer 108, etc.

FIG. 9 is an enlarged schematic view of the console 102 with rows 110, 112 of radio push buttons, and other customary control push buttons or levers such as the push button 116 provided for playing CD's, etc.

FIG. 10 is a circuit diagram for the alerting device of FIGS. 8-9. The battery 118 is the vehicle battery, and the GPS 124 can be the conventional GPS unit installed in the vehicle for route finding, etc., or it can be a separate unit provided with the alerting device.

The video and sound units 126, 128, and the transceiver 130 are part of the alerting device, and the video camera preferably is mounted inside or behind the dashboard 100 with a lens opening disguised as an ordinary small decoration or as part of an existing dashboard component, such as an air vent, radio, built-in navigating system, backup camera, or any part of the vehicle, such as the steering wheel, mirror, or mirror adjusting controls. The video camera preferably has a wide enough view angle to capture the images of both the driver and a passenger.

The two push buttons 114, which are close enough to one another to be pushed with two fingers of one hand, are buttons which normally are not pushed simultaneously. When they are pushed simultaneously or in close sequence to one another, they latch up and enable the operation of the GPS, video, sound, memory, transceiver units, and any other components mentioned previously; the transceiver operates only as a transmitter to transmit signals to an emergency personnel station, preferably a police station.

If there is an emergency in the vehicle, such as a car jacking, kidnapping or assault, pictures and sound in the vehicle will be transmitted to the emergency personnel station to let the personnel know the situation, location, and time of the event so they can dispatch a police car to the vehicle's location.

Preferably, the transceiver 130 does not act as a receiver because sound emitted by the sound unit would alert the perpetrator.

If the emergency does not include a perpetrator in the vehicle, another push button 132 can be used as a switch to convert the transceiver to operate as a receiver as well as a transmitter so that the emergency personnel can speak with the vehicle operator.

In the latter mode, the alerting device can be used by the person in the vehicle to report medical emergencies, natural disasters, drunk drivers, binge drinking, street fights, muggings, robberies, bomb plantings, mass murders, at schools or elsewhere, fires, explosions, etc. Rewards can be offered to encourage such reports.

As another feature of the invention, a second pair of switches is positioned out of sight on the steering column 106 (FIG. 8). If the vehicle operator, or passenger, cannot safely operate the switches 114, 116 he or she can operate the switches 120, 122 surreptitiously and enable the alerting device by that means.

Similarly, other switch sets can be located out of sight but within reach of a driver or passenger to enable him/her to actuate the alerting device without detection by a perpetrator inside or outside the vehicle.

The sound-operated method of actuation described above can be used as well, as can any of the aforementioned actuation methods noted above, when reasonable.

If a carjacker forces the ear owner out of the car after the alerting device has been actuated, the alerting device will continue to issue GPS signals to enable the car to be followed by police.

Other Vehicles

The invention also can be used in other vehicles such as motorcycles, motor scooters or motor bikes, all-terrain vehicles ("ATVs"), snowmobiles, boats, bicycles, etc. The motors of the powered vehicles can use hydrocarbon fuel, gaseous fuel, electric battery energy, photovoltaic panels, hybrids or any other types of power.

If the vehicle is open, additional precautions may be required—such as additional weatherproofing, theft protection, etc, as compared with devices hidden in enclosed vehicles.

FIG. 11 shows a portion 140 of the handle bar of a motorcycle, motor scooter or bike, snowmobile, ATV, etc.

The portion 140 includes a broken-away section 144 of the handlebars with an enlarged handle 142 which can be a rotatable throttle control for a motorized vehicle, or a simple stationary handle grip for a non-motorized vehicle.

A ring 146 abutting the handle 142 and made of the same material so as to look like part of the handle has two switches 148, 150 located more than 180° from one another. These are the actuating switches such as those described above as being opposite one another.

When a rider of the vehicles is accosted, it requires only a slight movement of the fingers which normally grip the handle to operate the switches to actuate the remote signaling operation as described above.

Switches can be located out of sight or disguised but accessible to the rider or a passenger to actuate the remote signaling.

It should be understood that, throughout this specification, switches located "opposite" one another need not be located 180° from one another, as long as they function for the purpose described herein.

General Transceiver Use

In general, every embodiment of the invention can be provided with a transceiver which normally only transmits, but as shown in FIG. 10, has a switch which can be operated to convert the transceiver to dual operation as a receiver. This is especially desirable when the device is used as a medical emergency device so that the medical patient can describe the ailment or predicament he or she is in, and instructions and reassurance can be received from medical personnel. Medical personnel will be able to see the patient/injured party, and view live health monitoring components' results, as well as be told of, locate, and view natural disasters as they occur or right before they occur, such as fires breaking out, oncoming tornado winds, earthquakes, etc.

Exemplary Users

Types of people who can make good use of the invention include the following: persons under threats of rape or other harm from present or former spouses, romantic partners, grudge bearers; children under dual custody agreements between divorced or separated parents; police officers; security guards; bank employees; restaurant employees; bodega, gas station or convenience store employees; jewelers or jewel salespersons; gay men; celebrities or wealthy people and their families; people in terrorist-infested areas of the world; people subject to medical emergencies, especially elderly people living alone; Alzheimer's victims; people living in crime-infested neighborhoods; government officials; news reporters; tourists; car service drivers; bus drivers; delivery personnel; miners; fishermen; realtors; janitors; landscapers; prison personnel; emergency medical personnel; bounty hunters; sales personnel; construction personnel; children subject to physical violence from others, including bullies; automobile and truck drivers; teachers or other school personnel; homeland security personnel; military personnel.

One particularly beneficial use of the alerting devices is in taking videos and/or still photographs of dangerous and emergency situations on the road (ie: road rage, drunken drivers, drive-by shootings, accidents, etc.). The video footage and/or photographs can be sent, with the GPS information, to the appropriate officials (ie: police department, fire department, etc.). Video footage and/or photographs can result in rewards from government departments to the person/s sending in the video footage and/or photographs.

Other Personal Articles

On the basis of the above-given examples, the alarm device of the present invention can be located in a wide variety of personal articles, using the same principles as those described above.

For example, other personal articles in which the invention can be positioned are: necklaces, earrings, bracelets, amulets, keychains, items of jewelry, wallets, pins, chokers, belts, cuff links, guns, knives, buckles, business card holders, money clips, TV remote controls, luggage ID cards, cameras, pens, laptops, sound reproducers, bicycle helmets, kneepads, wristpads, child's security blanket/teddy bear, canes, crutches, wheelchairs, robots, animal collars, animal harnesses, animal leashes, hats, flashlights, eyeglasses, eyeglass cases, lipstick cases, hearing aids, flash drives, lunch boxes, headphones, ear plugs, buttons, shoes, neckties, scarves, vests, jackets, clothing, badges, insignia, medallions, mace, personal alarm device, gun, mobile telephone, walkie-talkie and cb radio.

Personal communications devices can be used as concealed alarm devices in accordance with the invention. For example, cell phones, walkie-talkies, pagers, cb radios, etc. can be fitted with a transmitter, GPS, clock, microphone, video camera, all hidden within the device.

For personal communications devices, the transmitter is adapted for automatic communication with an emergency personnel location upon actuation of a signaling device other than that used by the unit in its usual means of communication.

Preferably, actuation of the alarm device is by simultaneous operation of two switches, such as two keys on a keypad, or two opposing buttons, not specially marked to identify their function.

Although the communications device is not disguised, its quick-acting alarm action is concealed, and can be used by partially-disabled persons, personally attacked persons, etc.; in emergencies such as tornadoes, floods, fires, accidents, where there is inadequate time or ability to dial a full phone number or other call in the normal mode of operation.

In both communication and non-communications devices, biometric sensors can be used to detect the heart rate, temperature or other bodily parameter and transmit that information when the alarm device is actuated. This will give medical personnel advance notice of the medical condition of the user so that the appropriate medical emergency equipment and personnel can be dispatched to the user's location, and provide ongoing surveillance of a patient in regard to their health and well-being, such as after heart surgery, or for diabetes, Alzheimer's disease, etc.

Exemplary Components

Miniature transceivers are readily available. For example, the Broadcom BCM4329 chip can be used to transmit and/or receive both wi-fi and radio communications. Other chips transmit and receive cellphone signals, as in ordinary cellphones. Ordinary RF transmission and reception can be provided by many different devices. A miniature camera usable in the device is a mini DVR camera. Additional ones or other types can be used if desired.

Receivers used at the emergency personnel stations are readily available. Preferably, they should have an indicator such as a lamp, sounding alarm and/or message on a screen which indicates whenever a signal is received from one of the alerting devices within range.

The range of transmission should be selected to suit the area and the environment in which the device is to be used, and the type of transmission used. Optionally, a switching device can be used to change the type of transmission used based on the location of the person using the alarm device; whether satellite, direct RF, etc.

Removable memory devices such as micro SD cards, SDHC, SDXC and their future improvements can be used to store video and audio signals, preferably after being compressed.

Lithium or other miniature long-lasting batteries can be used, as well as the vehicle battery in a vehicle.

Facial recognition, 3D facial recognition, fingerprint recognition, retinal and iris recognition, and voice recognition algorithms are well-known and available for use in connection with the optional actuation techniques described.

In each case, as the technology of each component changes, smaller size, lower cost, and better performance can be expected in the future.

As it can be seen from the foregoing, the invention provides a compact, camouflaged remote alarm device which is difficult for a perpetrator to detect and confiscate or disable, and yet is relatively easily operated surreptitiously so that a perpetrator is very unlikely to notice the actuation of the alarm device, even while holding the victim captive.

It should be understood that, preferably, the alarm device, once actuated, operates continuously to transmit the GPS information, time, etc., so as to enable emergency personnel to track the movements of the person who is carrying the article, until either the person turns off the alarm device or the battery runs down.

Alternatively, when it is necessary to conserve electric power, the information can be transmitted from the alarm device on a periodic basis, such as several times rapidly when initially actuated, and once per minute thereafter, until disabled. This type of operation can be enabled by programming the transmitter/transceiver.

Protecting Against Discovery

Measures can be taken to avoid, as much as possible, duplications of the look of concealed alerting devices. This can be done by restricting the number of different disguises used in products in a given geographical area.

For example, modules containing various alerting devices can be distributed to converters or manufacturers of bags, jewelry, wallets, watches, etc. for installation, with the stipulation that sales of each design in a given area is limited. Thus, it is less likely that a perpetrator will come to easily recognize a design which is hiding an alerting device.

Alternatively, manufacturers can make many products with the same exact design, some of which have and some of which do not have the disguise alarm device as a component of them. This is used to confuse perpetrators so that they cannot be sure who does and who does not have the alarm, and thus, make them think perhaps many people are alarmed and not to try to victimize anyone.

In vehicles, the devices should be hidden in different places in the vehicle, and multiple actuating means provided to prevent detection and disablement.

Exemplary Emergency Personnel

As noted above, among the emergency personnel, locations that can be notified by the alarm device of the invention are police stations, hospitals, family members or guardians, etc.

Other emergency personnel who can be notified include police, fire fighters, private security personnel, medical personnel, bomb control personnel, rescue personnel, ambulance personnel, military personnel, child protective services personnel, disease control and prevention personnel, animal protective services personnel, historic preservation personnel, news casting personnel, legal personnel, engineering and architecture personnel, drug and alcohol abuse prevention personnel, neighborhood watch personnel, emergency readiness teams, product safety personnel, Customs and Borders Protection personnel, Homeland Security personnel, Health and Human Services personnel, Departments of Labor personnel, equal opportunity agencies personnel, Labor Relations Authority personnel, land protection agencies personnel, park rangers, HUD personnel, immigration enforcement personnel, IRS personnel, Institute of Peace personnel, United Nations personnel, statistic agencies personnel, postal services personnel, Food and Drug Administration personnel, reconnaissance agencies personnel, recycling agencies personnel, refugee agencies personnel, OSHA personnel, BOCA personnel, transportation agencies personnel, trade agencies personnel, veterans agencies personnel, family members, friends, intelligence agency personnel, threat reduction agency personnel, and defense agency personnel.

In general, any personnel helpful in remedying an emergency can be notified. This can include medical specialists in the medical emergency likely to be suffered by a user of the alarm device, such as cardiologists, and specialists such as psychiatrists, psychologists, etc.

Service Organization

A service organization preferably is provided to distribute personal articles to users and arrange for appropriate personnel to respond to the signals received from the remote alerting devices and dispatch personnel to the scene of the emergency. The service organization can be compensated by sales of the alerting devices and monthly service fees.

Also, the service organization can gather statistical data based on the emergency signals, location, video/audio data transmitted, health monitoring data transmitted, etc., and keep a database of all such calls, and determine useful information which can be supplied to others to improve the safety of certain problem areas, etc.

The service organization would record instances when the concealment of the alerting device has been breached and other data to guide it in controlling the proliferation of devices of the same type in the same area or in contiguous areas.

Although the invention has thus been shown and described with reference to specific embodiments, it should be noted that the invention is in no way limited to the details of the described arrangements but changes and modifications may be made without departing from the scope of the invention which is defined by the appended claims.

The invention claimed is:

1. An emergency alerting device, said device comprising (a) a non-communications personal article to be carried by a person to be protected by said device (b) said personal article having a housing, (c) an electrical power source, (d) a wireless transmitter in said housing, said transmitter being set to transmit wireless signals to a receiving station for alerting emergency personnel at said station, (e) a location device in said housing for determining the position of said housing and delivering signals to said transmitter indicating said position, (f) a clock device for keeping the current time and delivering a signal to said transmitter indicating said time, (g) a switching device for connecting said transmitter and said location device to said power source and thereby starting the wireless transmission of signals by said transmitter to said receiving station, said switching device comprising a pair of toggle switches which are connected so as to require both switches to be actuated to start the operation of said transmitter, said switches being spaced apart on said personal article in proximity to one another so that both can be actuated or de-actuated with one hand, said toggle switches including latching means to hold them closed until operated again to open them, (h) said personal article being made to look like other such personal articles without appearing to be an alerting device.

2. A device as in claim 1 in which said switches are spaced apart on said personal article opposite one another so that said switches can be actuated or de-actuated by pressing said switches towards one another with one hand.

3. A device as in claim 1 in which said personal article is selected from the group consisting of pendants, necklaces, earrings, bracelets, amulets, keychains, items of jewelry, purses, brief cases, attaches, shoulder bags, book bags, suitcases, wallets, watches, pins, chokers, belts, cuff links, guns, knives, buckles, business card holders, money clips, TV remote controls, luggage ID cards, cameras, pens, laptops, sound reproducers, helmets, kneepads, wristpads, canes, crutches, wheelchairs, hearing aids, robots, enclosed motor vehicles, other motor vehicles, animal collars, animal harnesses, animal leashes, hats, flashlights, cigarette lighters, eyeglasses, eyeglass cases, lipstick cases, hearing aids, flash drives, lunch boxes, headphones, ear plugs, buttons, shoes, neckties, scarves, vests, jackets, badges, insignia, medallions, mace, personal alarm devices, guns, mobile telephones, walkie-talkies, cb radios, and clothing.

4. A device as in claim 1 in which said emergency personnel is selected from the group consisting of: police, fire fighters, private security personnel, medical personnel, bomb control personnel, rescue personnel, ambulance personnel, military personnel, child protective services personnel, disease control and prevention personnel, animal protective services personnel, historic preservation personnel, news casting personnel, legal personnel, engineering and architecture personnel, drug and alcohol abuse prevention personnel, neighborhood watch personnel, emergency readiness teams, product safety personnel, Customs and Borders Protection personnel, Homeland Security personnel, Health and Human Services personnel, Departments of Labor personnel, equal opportunity agencies personnel, Labor Relations Authority personnel, land protection agencies personnel, park rangers, HUD personnel, immigration enforcement personnel, IRS personnel, Institute of Peace personnel, United Nations personnel, statistic agencies personnel, postal services personnel, Food and Drug Administration personnel, reconnaissance agencies personnel, recycling agencies personnel, refugee agencies personnel, OSHA personnel, BOCA personnel, transportation agencies personnel, trade agencies personnel, veterans agencies personnel, family members, friends, intelligence agency personnel, threat reduction agency personnel, and defense agency personnel.

5. A device as in claim 1 in which said wireless transmitter has a control device for causing it to transmit in a mode selected from the group consisting of continuously and intermittently until disabled, and including monitoring devices to monitor the health status of a person carrying the alerting device, including the person's temperature, heart rate, steps taken, and walking velocity, body mass index, blood pressure, insulin level, blood alcohol concentration, etc.

6. A device as in claim 1 in which said transmitter is a transceiver normally operating in the transmit only mode, with a further switch to enable receiving mode in addition, and in which said transmitter is disabled by an event selected from the group consisting of operation of said switching device and power source failure.

7. A device as in claim 1 in which said switching device is selected from the group consisting of biometric sensors including fingerprint recognition, facial recognition, skin texture recognition, retinal and iris scan recognition, sound recognition, manual switches, and combinations of manual switches with biometric sensors.

8. A method of providing personal protection against emergencies, said method comprising the steps of (a) providing a person to be protected with at least one personal article made to have the appearance of such an article but containing an alerting device comprising a wireless transmitter, a location signal device to deliver to said transmitter a signal indicating the location of said article, a clock signal device for delivering a time-indicating signal to said transmitter, and an identification signal, and a switching device operable by said person to enable said transmitter and said signal devices, said switching device comprising a pair of toggle switches which are connected so as to require both switches to be actuated to start the operation of said transmitter, said toggle switches including latching means to hold them closed until operated again to open them, said switches being spaced apart on said personal article in proximity to one another so that both can be actuated or de-actuated with one hand, (b) informing emergency personnel located at a station having a receiver for receiving signals transmitted by said transmitter of the transmitter(s) deployed in the possession of persons to be protected thereby, and (c) arranging for said personnel to respond to said transmitted signals.

9. A method as in claim 8 including the step of selecting the type of wireless transmission to be used based on the main environment anticipated for said person's location, and/or switched automatically or manually based on the person's location.

10. A method as in claim 8 including providing as said switching device switches selected from the group comprising manual switches operable by opposed fingers of one hand of a person, biometric switches, and using said manual and/or said biometric switches to activate said alerting device.

11. A method as in claim 8 including selecting said station from the group consisting of police, fire fighters, private security personnel, medical personnel, bomb control personnel, rescue personnel, ambulance personnel, military personnel, child protective services personnel, disease control and prevention personnel, animal protective services personnel, historic preservation personnel, news casting personnel, legal personnel, engineering and architecture personnel, drug and alcohol abuse prevention personnel, neighborhood watch personnel, emergency readiness teams, product safety personnel, Customs and Borders Protection personnel, Homeland Security personnel, Health and Human Services personnel, Departments of Labor personnel, equal opportunity agencies personnel, Labor Relations Authority personnel, land protection agencies personnel, park rangers, HUD personnel, immigration enforcement personnel, IRS personnel, Institute of Peace personnel, United Nations personnel, statistic agencies personnel, postal services personnel, Food and Drug Administration personnel, reconnaissance agencies personnel, recycling agencies personnel, refugee agencies personnel, OSHA personnel, BOCA personnel, transportation agencies personnel, trade agencies personnel, veterans agencies personnel, family members, friends, intelligence agency personnel, threat reduction agency personnel, and defense agency personnel.

12. A method as in claim 8 including selecting said personal article from the group consisting of pendants, necklaces, earrings, bracelets, amulets, keychains, items of jewelry, purses, brief cases, attachés, shoulder bags, book bags, suitcases, wallets, watches, pins, chokers, belts, cuff links, guns, knives, buckles, business card holders, money clips, TV remote controls, luggage ID cards, cameras, pens, laptops, sound reproducers, helmets, kneepads, wristpads, canes, crutches, wheelchairs, hearing aids, robots, motor vehicles, animal collars, animal harnesses, animal leashes, hats, flashlights, cigarette lighters, eyeglasses, eyeglass cases, lipstick cases, hearing aids, flash drives, lunch boxes, headphones, ear plugs, buttons, shoes, neckties, scarves, vests, jackets, badges, insignia, medallions, mace, personal alarm devices, guns, mobile telephones, walkie-talkies, cb radios, and clothing.

13. A method as in claim 8 including a microphone and recorder for receiving and transmitting to said transmitter sound and recording same and removable sound record storage media, and removing same for use in identifying crime perpetrators.

14. A method as in claim 8 including a video camera and recorder with a removable record medium therefore, and using said camera to record images of a crime perpetrator and removing said record medium to identify a crime perpetrator.

15. A method as in claim 8 including distributing modules containing alerting devices with at least the basic components of a power source, transmitter, GPS and clock to manufacturers or converters of personal articles to contain the components, and, in order to maintain the covert nature of the alerting device, selecting a step from the group consisting of controlling dissemination of said personal articles to ensure that only limited numbers of similar personal articles are issued in a given area over a given time, and controlling manufacturing to ensure sales of substantial numbers of the same devices by each manufacturer, with some having no alerting device and others containing alerting devices.

16. An emergency alerting device in a vehicle, said device comprising (a) a wireless transmitter, (b) a location device, (c) a clock device, said transmitter, location device and said clock device being hidden by being located out of sight or disguised in or on said vehicle, (i) at least one switching device for controlling said device, said switching device being located in a location selected from the group consisting of conventional vehicle or vehicle accessory controls, and hidden locations accessible to at least the driver or a passenger in or on said vehicle to operate, said switching device comprising a pair of toggle switches which are connected so as to require both switches to be actuated to start the operation of said transmitter, said toggle switches including latching means to hold them closed until operated again to open them, (d) said switches being spaced apart on said personal article in proximity to one another so that both can be actuated or de-actuated with one hand, (e) a power source, (f) said transmitter set to transmit location information and the time of transmission to an emergency personnel location when said switching device is actuated to connect said transmitter to said power source.

17. A device as in claim 16 in which said transmitter is a transceiver set to transmit only mode, and including a further switch to enable said transceiver to both transmit and receive.

18. A device as in claim 16 including a video camera and a microphone connected to said transmitter to view and register sound from driver and passengers, and a removable storage device, for storing audio and video signals.

* * * * *